US005393158A

United States Patent [19]

Dall'Arancio

[11] Patent Number: 5,393,158

[45] Date of Patent: Feb. 28, 1995

[54] TRANSPARENT MOUNT FOR PHOTOGRAPH ALBUM

[75] Inventor: Davide Dall'Arancio, Faenza, Italy

[73] Assignee: SEPA S.r.l., Italy

[21] Appl. No.: 222,864

[22] Filed: Apr. 5, 1994

[30] Foreign Application Priority Data

Apr. 9, 1993 [IT] Italy ..... B093 U 000079

[51] Int. Cl.[6] ..... B42F 13/00

[52] U.S. Cl. ..... 402/79; 281/38; 40/156

[58] Field of Search ..... 283/61; 402/74, 80 P; 281/38, 35; 40/156, 159

[56] References Cited

U.S. PATENT DOCUMENTS

| | | | |
|---|---|---|---|
| 4,979,619 | 12/1990 | Hagen | 40/156 |
| 5,040,671 | 8/1991 | Hagen | 40/156 |
| 5,087,145 | 2/1992 | Cooley | 402/79 |
| 5,162,827 | 11/1992 | Marshall | 40/156 |

*Primary Examiner*—Willmon Fridie

*Attorney, Agent, or Firm*—Larson and Taylor

[57] ABSTRACT

The mount is formed by at least two sheets of transparent plastic material and an optional opaque intermediate sheet, all of quadrilateral shape, with bevelled corners, fixed to each other along part of their perimeter so that they form one or two back-to-back pockets of such a size that they hold with a sufficient margin a photograph with either a horizontal or a vertical disposition, the said pocket or pockets being provided for this purpose with apertures on two consecutive sides, through which the photographs can be inserted into the mount with the necessary orientation to enable them to be correctly viewed from a fixed observation point without the necessity of rotating the mount. The mount is provided with internal welds which ensure correct centering and retention of the photographs in the mount, regardless of their orientation. The opaque intermediate sheet is preferably of any suitable colour contrasting with the photographs and has a rough surface to keep the photographs in place.

10 Claims, 1 Drawing Sheet

TRANSPARENT MOUNT FOR PHOTOGRAPH ALBUM

BACKGROUND OF THE INVENTION

The present invention relates to the mounts for photograph albums.

There are known mounts for photograph albums formed from transparent sheets of weldable plastic material, welded to each other at their edges to form pockets with sizes suitable for containing one or two photographs back-to-back. In the mounts of the above type, the pockets for containing the photographs vary in size according to the format of the photographs, and are open on one side only, generally on a short side, and therefore the photograph has to be inserted into the pocket with a certain disposition, even if it should be orientated differently in order to be seen correctly without the necessity of rotating the album.

SUMMARY OF THE INVENTION

It is the scope of the present invention to provide a mount for photograph albums which avoids to the drawbacks and disadvantages of the known prior art mounts.

According to the invention a mount for a photograph album is provided, having at least one pocket with dimensions in a plan view sufficient to contain at least one photograph with either a horizontal disposition or a vertical disposition, the pocket being open on two consecutive sides to form two apertures, at an angle of 90° to each other, through wich the photograph can be inserted into the pocket with a horizontal disposition or a vertical disposition as required.

According to another feature of the invention, the mount is further provided with suitable internal welds, which ensure the correct centering and retention of the photograph in the pocket or pockets of the mount, independently of the orientation of the photograph.

Advantageously, each mount is preferably formed from three superimposed sheets of suitable plastic material, the outer ones of which are transparent, while the intermediate sheet is opaque, has a colour such that it forms an effective perimetric contrast for the photograph, and has its surfaces suitably rough to retain the photographs in the mount.

When looking through a photograph album made with mounts according to the invention, it is possible to correctly view the photographs with horizontal disposition or with vertical disposition, without the necessity of rotating the album as is the case in the known art.

BRIEF DESCRIPTION OF THE DRAWINGS

Further characteristics of the mount according to the invention, and the advantages derived therefrom, will be evident from the following description made with reference to the accompanying drawings, in which.

DESCRIPTION OF THE PREFERRED EMBODIMENT OF THE INVENTION

Figure 1:
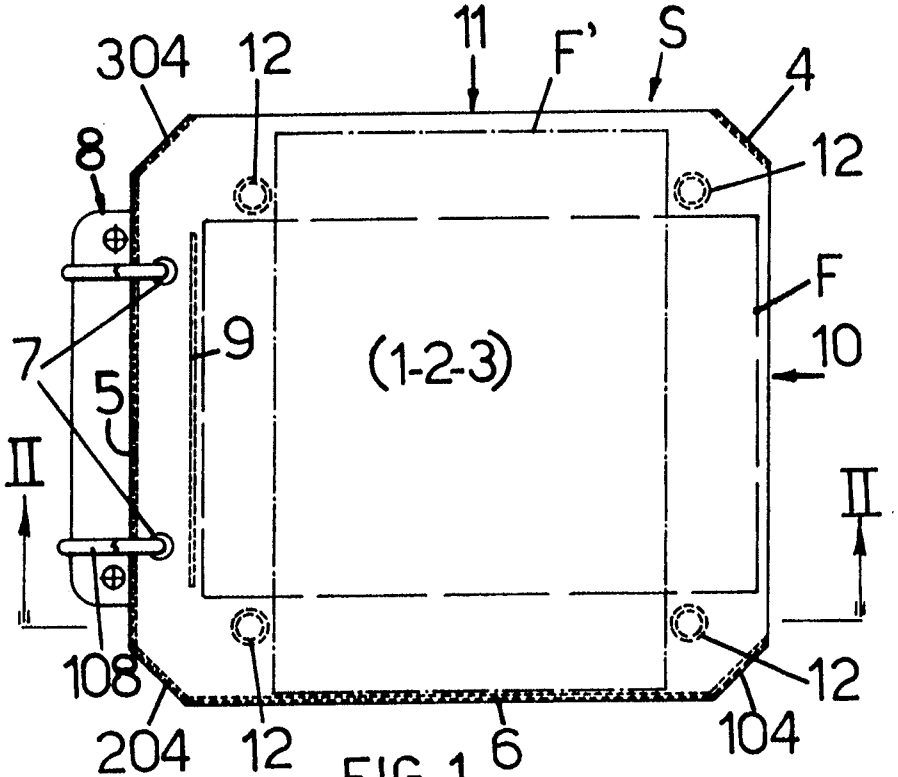
FIG. 1 is a top plan view of a mount according to the invention.
Figure 2:
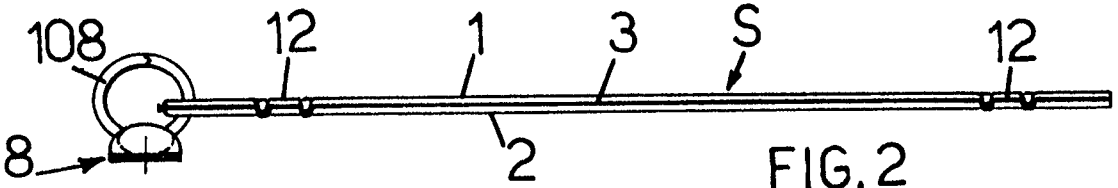
FIG. 2 shows further details of the mount shown in FIG. 1, in section along the line II—II.

With reference to FIGS. 1 and 2, the photograph mount S shown is formed from one pair of transparent weldable plastics sheets 1 and 2, between which a third sheet 3, which is also made from weldable plastics material, is disposed. The sheet 3 is made of opaque material and has a colour suitable for the formation of a contrasting background for the photographs. Advantageously, the intermediate sheet 3 may be provided with surfaces which are embossed, micro-pitted, satin-finished, or otherwise toughened, and is for example black in colour.

The sheets 1-2-3 are of identical shape, proportionate to the format of the photographs to be stored, and are for example quadrilateral, with the corners bevelled at 45° or rounded and are welded together in all the corner areas, as indicated by 4-104-204-804. The size of the mount is such that the photograph of the predetermined format can be contained in it with a sufficient play, in either horizontal or vertical disposition.

The sheets 1-2-3 are welded together on two consecutive sides, as indicated by 5 and 6, and one of these sides, for example 5, of the mount S formed by the sheets 1-2-3 is made so that it can be joined in a book with other identical mounts, to form a photograph album. The other welded side 6 is orientated downwards. In the example, illustrated purely as an indication and without restriction, the mount S has, on the short welded side 5, symmetrically disposed holes 7 with which the mount can be connected and hinged to the openable rings 108 of a clamp 8 of known type fixed to the inner face of the spine of a photograph album cover. Preferably, the holes 7 have welded edges and/or are surrounded by a weld which has the purpose of reinforcing the edges and preventing them from breaking when they slide on the rings 108.

At a short distance from and parallel to the welded side 9, the mount S is provided with a weld line 9 and the holes 7 are located in the space between this weld line and the side 5. The distance between the weld line 9 and the apertures 10 of the mount S is substantially equal to the distance between the welded side 6 and the apertures 11 of the mount, and this distance is proportionate to the format of the photograph for which the mount S was designed. If the photograph F is to be orientated horizontally, as indicated by the broken line in FIG. 1, it is inserted into the mount S through one of the apertures 10, so that it is visible through one of the transparent walls 1 or 2, and until it meets the weld line 9, while the opposite side of the photograph F passes conveniently beyond the aperture 10 so that it is contained within the mount. Conversely, if the photograph F′ is to be orientated vertically, as indicated by the dot-and-dash line in FIG. 1, the photograph is inserted into the mount S through one of the apertures 11, until it meets the welded side 6, while the opposite side of the photograph passes conveniently beyond the aperture 11 so that it is contained within the mount.

To ensure that the photograph is conveniently centered and orientated in the mount S, independently of the orientation with which it was inserted in the mount, the mount S is provided, in the areas of the external angles of the hypothetical intersection of two differently orientated photographs F—F′, with welds 12, preferably of annular and round shape, to provide an effective guide for the correct insertion of photographs into the pockets of the mount S.

If the photographs are inserted into the two pockets of the mount with different orientations, the intermediate opaque sheet 3 impedes the view of the intersection of the photographs, which would be rather unattractive. The sheet 3 not only forms an effective frame for the photographs, but also, with its rough surface, retains the photographs in the mount and prevents them from falling out unintentionally.

Figure 3:
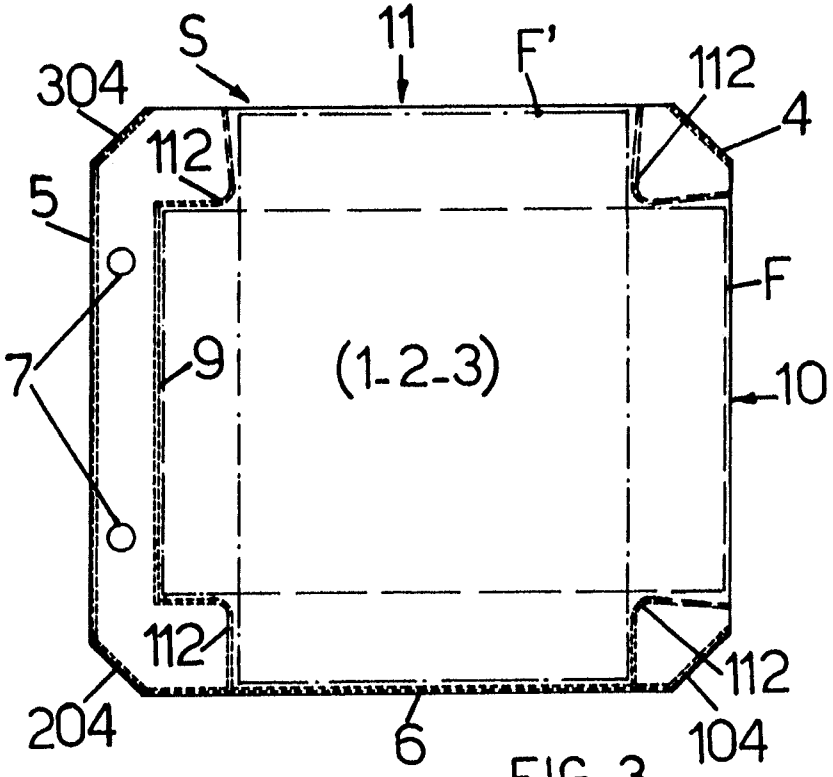
FIG. 3 is a top plan view of a second embodiment of the mount according to the invention.

Minor modifications to the mount as described are possible. For example the welds on the side 5 and possibly also at the corner areas 204–304 or also at 4–104 may be eliminated. As illustrated in FIG. 3, the welds 12 may be replaced by weld lines 112, for example of V shape, with a rounded corner area, reaching the apertures 10–11, with a guiding shape which facilitates the insertion of the photographs into the pockets of the mount.

I claim:

1. A transparent mount for a photograph album comprising two sheets of transparent plastic material, superimposed and welded together along part of their perimeter, to form at least one pocket for containing one or two back-to-back photographs which are visible through the transparent walls of the pocket, said pockets having a size in plan view such as to contain a photograph with either a horizontal or a vertical disposition, said pockets being open on two consecutive sides to form two apertures at an angle of 90° to each other through which the photograph can be inserted into the pocket with the correct orientation for its correct viewing.

2. A mount according to claim 1 further comprising a third intermediate sheet secured to the two outer transparent sheets, said intermediate sheet being made of opaque material and having a colour contrasting with the photographs.

3. A mount according to claim 1 wherein the said apertures in said pockets are preferably disposed on the outwardly directed side and on the top directed side of the mount.

4. A mount according to claim 1 wherein said intermediate sheet includes at least one of a roughened surface or a decorated surface.

5. A transparent mount for a photograph album comprising two sheets of transparent plastic material, superimposed and welded together along part of their perimeter to form at least one pocket for containing back-to-back photographs which are visible through the transparent walls of the pocket, the at least one pocket having a sufficient size for containing a photograph with either a horizontal or a vertical disposition, the at least one pocket being open on two consecutive sides to form two apertures at an angle of 90° to each other through which the photograph is insertable into the pocket with the correct orientation for its correct viewing, the mount further including welds extending through all sheets of the mount in external corner angles of the mount, said corner angles being formed by a hypothetical intersection of a horizontally oriented photograph centered in said mount with a vertically oriented photograph centered in said mount, said welds providing means for centering the photograph in the mount, regardless of whether it is inserted horizontally or vertically, and of stably retaining the photograph in the orientation with which it was inserted into the mount.

6. A mount according to claim 5 wherein said welds comprise an annular, rounded form and form an effective guide for the correct insertion of the photograph into the at least one pocket.

7. A mount according to claim 5 wherein said welds comprise a substantially V-shaped form, with rounded corner areas, and reach the apertures of the at least one pocket of the mount with a precise divergence towards the edges of the mount, to form an effective guide for the correct insertion of the photograph into the at least one pocket.

8. A mount according to claim 1, having a rectangular form and wherein said corner areas have one of a bevelled or a rounded shape, and the support is welded on two consecutive sides, one of said consecutive sides being on the side intended to be joined in a book with other identical mounts and with a cover to form the album, the mount being positioned at equal distances from the side intended to be joined in a book and including at least one pair of holes for engaging the mount on the openable rings of a binder clamp fixed on the inner face of the spine of said cover.

9. A mount according to claim 1 further comprising a weld line parallel to the side with which said mount is prepared for hinging in book form with other mounts to form the album, said line being spaced from the corresponding parallel aperture of the pocket by a distance substantially equal to the distance between the other aperture of the pocket and the welded side parallel to it.

10. A mount according to claim 8 wherein said at least one pair of holes are welded at edges thereof through all sheets of the mount.

* * * * *